US007273361B2

(12) United States Patent
Park

(10) Patent No.: US 7,273,361 B2
(45) Date of Patent: Sep. 25, 2007

(54) COUPLING STRUCTURE OF ECCENTRIC BUSH OF SCROLL COMPRESSOR

(75) Inventor: Kyu-Hyung Park, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 131 days.

(21) Appl. No.: 11/093,282

(22) Filed: Mar. 30, 2005

(65) Prior Publication Data

US 2005/0220650 A1 Oct. 6, 2005

(30) Foreign Application Priority Data

Mar. 31, 2004 (KR) ..... 10-2004-0022439

(51) Int. Cl.
*F01C 1/02* (2006.01)
*F01C 1/063* (2006.01)
*F03C 2/00* (2006.01)
*F03C 4/00* (2006.01)

(52) U.S. Cl. ..... 418/55.1; 418/55.5; 418/57

(58) Field of Classification Search ..... 418/55.5, 418/57, 55.1, 182; 464/102, 103, 104, 105; 249/99

See application file for complete search history.

(56) References Cited

U.S. PATENT DOCUMENTS 5,779,461 A * 7/1998 Iizuka et al. ..... 418/55.5
6,676,391 B2 * 1/2004 Koo et al. ..... 418/55.5

FOREIGN PATENT DOCUMENTS

KR 10-0400573 10/2003

* cited by examiner

*Primary Examiner*—Thomas Denion
*Assistant Examiner*—Douglas J. Duff
(74) *Attorney, Agent, or Firm*—Birch, Stewart, Kolasch & Birch, LLP

(57) ABSTRACT

A coupling structure of an eccentric bush of a scroll compressor, comprising: an orbiting scroll; a rotary shaft provided with an eccentric part and transferring rotary power of a driving motor to the orbiting scroll; and an eccentric bush coupled between the orbiting scroll and the eccentric part of the rotary shaft, wherein an insertion hole provided with two plane contact portions having predetermined areas is formed at the eccentric bush, a cutting surface surface-contacting the plane contact portions of the eccentric bush is formed at the eccentric part of the rotary shaft, and the eccentric part is inserted into the insertion hole of the eccentric bush. Accordingly, damage to the eccentric bush or the rotary shaft can be prevented by dispersing the power applied to the rotary shaft and the eccentric bush.

8 Claims, 6 Drawing Sheets

COUPLING STRUCTURE OF ECCENTRIC BUSH OF SCROLL COMPRESSOR

BACKGROUND OF THE INVENTION

1. Field of the Invention

The present invention relates to a scroll compressor, and more particularly, to a coupling structure of an eccentric bush of a scroll compressor capable of preventing damage to the eccentric bush or a rotary shaft by dispersing the power applied to the rotary shaft and the eccentric bush during the operation of the compressor.

2. Description of the Background Art

In general, a compressor converts electric energy into kinetic energy, and compresses a refrigerant by the kinetic energy. The compressor is the kernel of a freezing cycle system. According to a compression mechanism for compressing a refrigerant gas, there are various kinds of compressors such as a rotary compressor, a scroll compressor, a reciprocal compressor and the like. Such compressors are used in a refrigerator, an air conditioner, a showcase and the like.

FIG. 1 is a cross-sectional view illustrating one embodiment of the scroll compressor.

As shown therein, the scroll compressor includes: a casing 10 provided with a suction pipe 11 and a discharge pipe 12; a main frame 20 and a sub-frame 30 fixedly coupled to the upper and lower portions inside the casing 10, respectively, with a certain interval; a fixed scroll 40 fixedly coupled to the casing 10 so as to be positioned at an upper side of the main frame 20; an orbiting scroll 50 positioned between the fixed scroll 40 and the main frame 20 so as to be orbitably interlocked with the fixed scroll 40; an Oldham ring 60 positioned between the fixed scroll 40 and the main frame 20, for preventing a self-rotation of the orbiting scroll 50; a driving motor (M) fixedly coupled to the casing 10 so as to be positioned between the main frame 20 and the sub-frame 30, for generating a driving force; a rotary shaft 70 for transferring the driving force of the driving motor (M) to the orbiting scroll 50; and a valve assembly 80 mounted on an upper surface of the fixed scroll 40.

The main frame 20 includes: a shaft insertion hole 22 formed at a frame body portion 21 of predetermined shape, into which the rotary shaft 70 is penetratingly inserted into; a boss insertion groove 23 communicating with the shaft insertion hole 22 having an inner diameter greater than that of the shaft insertion hole 22; and a bearing surface 24 formed at an upper surface of the frame body portion 21, by which the orbiting scroll 50 is supported.

The fixed scroll 40 includes: a body portion 41 having a predetermined shape; a wrap 42 formed in an involute curve shape of predetermined thickness and height at one surface of the body portion 41; a discharge hole 43 penetratingly formed at the center portion of the body portion 41; and a suction hole 44 formed at one side of the body portion 41.

The orbiting scroll 50 includes: a circular plate part 51 having certain thickness and area; a wrap 52 formed in an involute curve shape of certain thickness and height at one side of the circular plate part 51; a boss part 53 penetratingly formed at the center portion of the other side of the circular plate part 51 to a certain height; and a shaft insertion groove 54 formed inside the boss part 53 to a certain depth, into which part of the rotary shaft 70 is inserted. The orbiting scroll 50 is coupled between the fixed scroll 40 and the main frame 20 such that the wrap 52 of the orbiting scroll 50 is interlocked with the wrap 42 of the fixed scroll, the boss part 53 is inserted into the boss insertion groove 23 of the main frame 20, and one surface of the circular plate part 51 is supported by the bearing surface 24 of the main frame.

The rotary shaft 70 includes: a shaft part 71 having a certain length; an eccentric part 72 extending from one side of the shaft part 71 to a certain length so as to be eccentric from the center of the shaft part 71; and an oil path 73 penetratingly formed at the shaft part 71 and the eccentric part 72.

As for the rotary shaft 70, the shaft part 71 is coupled with the driving motor (M). One side of the shaft part 71 of the rotary shaft 70 is penetratingly inserted into the shaft insertion hole 22 of the main frame and the eccentric part 72 is inserted into the shaft insertion groove 54 of the orbiting scroll.

Then, an eccentric bush 90 in a predetermined shape is inserted into the eccentric part 72 of the rotary shaft, and a fixed bush 100 slidingly contacting the eccentric bush 90 is fixedly coupled with an inner wall of the shaft insertion groove 54 of the orbiting scroll.

The oil is filled at the lower part of the casing 10.

Undescribed reference numerals 110, 120, 130, 140 and 150 are a stator, a rotor, a balance weight, an oil feeder and a high and low pressure separator, respectively.

An operation of the scroll compressor having such a construction will be described as follows.

If the power is applied to the scroll compressor, rotary power is generated from the driving motor (M) by the operation of the driving motor (M), and the rotary power of the driving motor (M) is transferred to the orbiting scroll 50 through the rotary shaft 70. As the rotary power of the rotary shaft 70 is transferred to the orbiting scroll 50, the orbiting scroll 50 coupled to the eccentric part 72 of the rotary shaft 70 orbits on the basis of a central axis of the rotary shaft 70. Prevented from its self-rotation by means of the Oldham ring 60, the orbiting scroll 50 orbits.

As the orbiting scroll 50 orbits, the wrap 52 of the orbiting scroll is interlocked with the wrap 42 of the fixed scroll. By the orbiting movement of the orbiting scroll, a plurality of compression pockets (P) formed by the wrap 52 of the orbiting scroll and the wrap 42 of the fixed scroll are moved into the center portion of the fixed scroll 40 and the orbiting scroll 50 and gradually contracted in volume.

The compression pockets suck, compress and discharge the gas through the discharge hole 43 of the fixed scroll.

The oil filled in the lower part of the casing 10 flows via the oil path 73 of the rotary shaft by the rotation of the rotary shaft 70 and is supplied to components where a sliding motion is generated.

Meanwhile, by the rotation of the rotary shaft 70, the eccentric part 72 of the rotary shaft moves in a circular motion by taking a distance eccentric from the center of the shaft part 71 of the rotary shaft as a rotating radius and the circular motion of the eccentric part 72 of the rotary shaft is transferred to the boss part 53 of the orbiting scroll, whereby the orbiting scroll 50 orbits. In addition, the eccentric bush 90 inserted into the eccentric part 72 not only prevents direct friction between the eccentric part 72 of the rotary shaft and the boss part 53 of the orbiting scroll but also keeps the rotation of the rotary shaft 70 stable.

FIG. 2 is a plan view showing a coupling structure of the conventional eccentric bush.

As shown therein, the coupling structure of the eccentric bush is as follows.

The eccentric part 72 of the rotary shaft is constructed in such a manner that a cutting plane (F1) cut to have a certain plane is formed at one outer circumferential surface of a cylindrical shape with certain length and outer diameter. The center of the eccentric part 72 is eccentric from the center of the shaft part 71 with a certain distance.

The eccentric bush 90 includes a cylindrical body portion with certain length and outer diameter and an insertion hole 92 penetrated into the cylindrical body portion 91 in a longitudinal direction. The insertion hole 92 has an inner diameter corresponding to an outer diameter of the eccentric part 72, and has a plane portion (F2) having a certain width at its one inner circumferential surface. The center of the insertion hole 92 is positioned to be eccentric from that of the cylindrical body portion 91 with a certain distance. The area of the plane portion (F2) of the eccentric bush 90 is smaller than that of the cutting plane (F1) formed at the outer circumferential surface of the eccentric part of the rotary shaft.

The eccentric bush 90 is coupled with the rotary shaft 70 such that the eccentric part 72 is inserted into the insertion hole 92. The plane portion (F2) formed at one inner circumferential surface of insertion hole 92 of the eccentric bush and the cutting plane (F1) of the eccentric part maintain a predetermined interval therebetween, through which the oil is supplied.

In addition, the eccentric bush 90 coupled to the eccentric part 72 of the rotary shaft is inserted into the shaft insertion groove 54 formed at the boss part 53 of the orbiting scroll.

If rotary power of the driving motor (M) is transferred to the rotary shaft 70 and thus the shaft part 71 of the rotary shaft rotates, the eccentric part 72 of the rotary shaft moves in a circular motion and the circular motion of the eccentric part 72 is transferred to the orbiting scroll 50 through the eccentric bush 90, whereby the orbiting scroll 50 orbits.

However, in the coupling structure of the eccentric bush, as shown in FIG. 3, when the compressor operates or is stopped, the edge of the cutting plane (F1) of the eccentric part of the rotary shaft comes in contact with and bumps against the plane portion (F2) of the eccentric bush. As the eccentric part 72 of the rotary shaft bumps against the eccentric bush 90 repetitively, a crack is generated on the eccentric bush 90 since concentrated stress is repetitively applied to a specific portion of the eccentric bush 90 of relatively low intensity. The eccentric bush 90 is damaged in certain circumstances.

SUMMARY OF THE INVENTION

Therefore, an object of the present invention is to provide a coupling structure of an eccentric bush of a scroll compressor capable of preventing damage to the eccentric bush or a rotary shaft by dispersing the power applied to the rotary shaft and the eccentric bush during the operation of the compressor.

To achieve these and other advantages and in accordance with the purpose of the present invention, as embodied and broadly described herein, there is provided a coupling structure of an eccentric bush of a scroll compressor, comprising: an orbiting scroll; a rotary shaft provided with an eccentric part and transferring rotary power of a driving motor to the orbiting scroll; and an eccentric bush coupled between the orbiting scroll and the eccentric part of the rotary shaft, wherein an insertion hole provided with two plane contact portions having predetermined areas is formed at the eccentric bush, a cutting surface surface-contacting the plane contact portions of the eccentric bush is formed at the eccentric part of the rotary shaft, and the eccentric part is inserted into the insertion hole of the eccentric bush.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a coupling structure of an eccentric bush of a scroll compressor of the present invention will be described in detail according to embodiments illustrated in the accompanying drawings.

Figure 1:
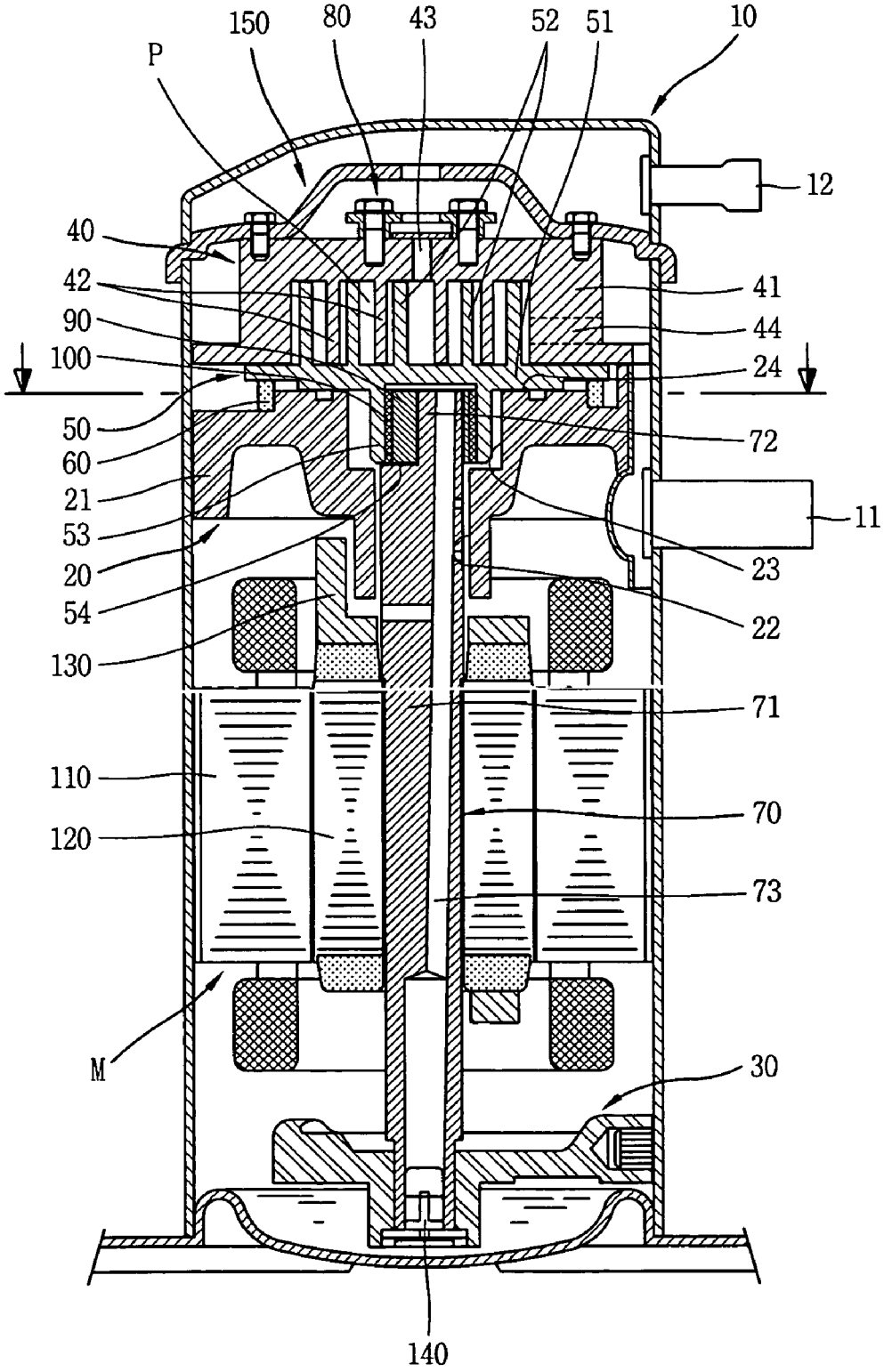
FIG. 1 CONVENTIONAL ART
FIG. 1 is a front section view illustrating a scroll compressor provided with a coupling structure of an eccentric bush of the conventional scroll compressor.
Figure 2:
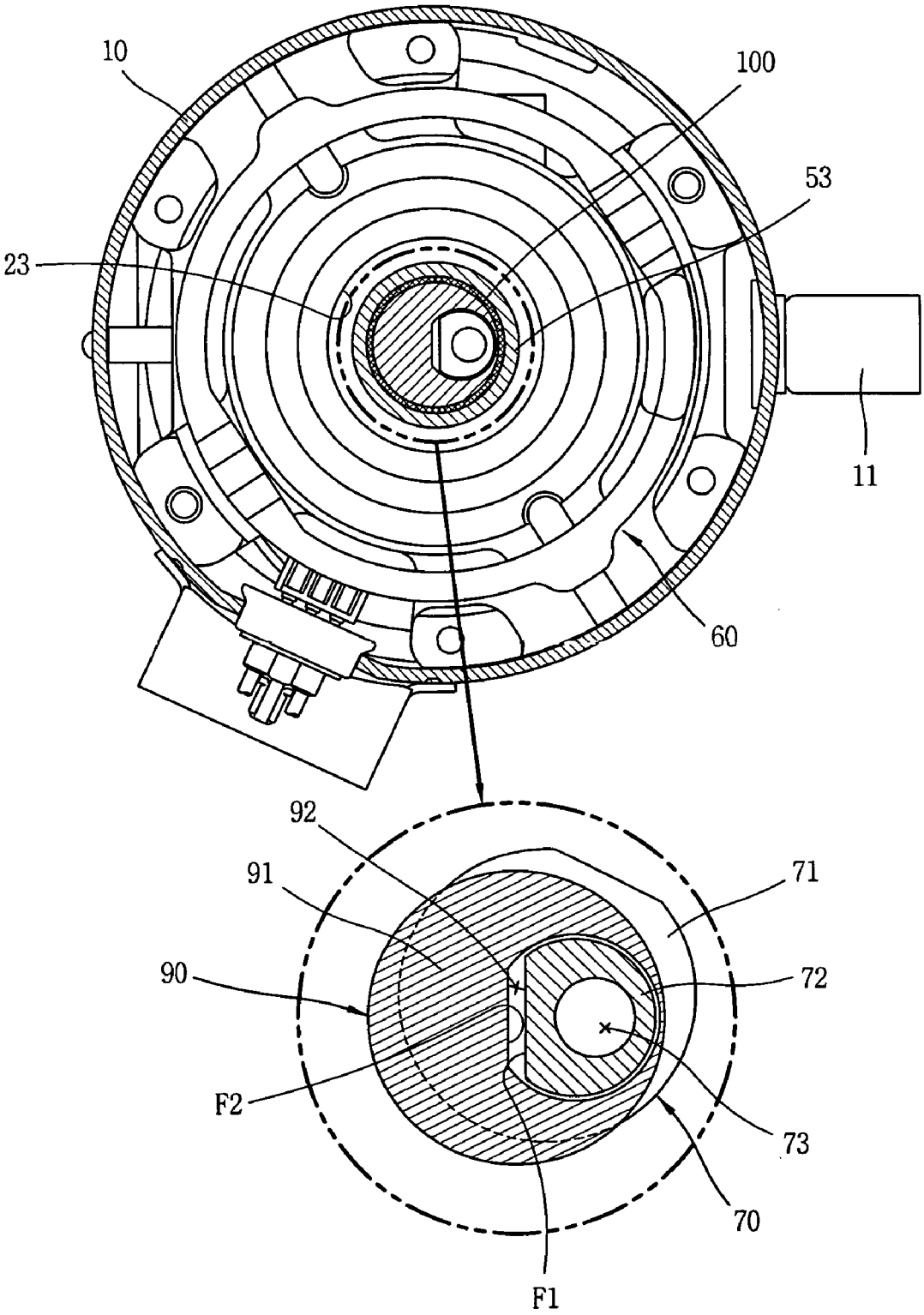
FIG. 2 CONVENTIONAL ART
FIG. 2 is a plan section view showing the scroll compressor.
Figure 3:
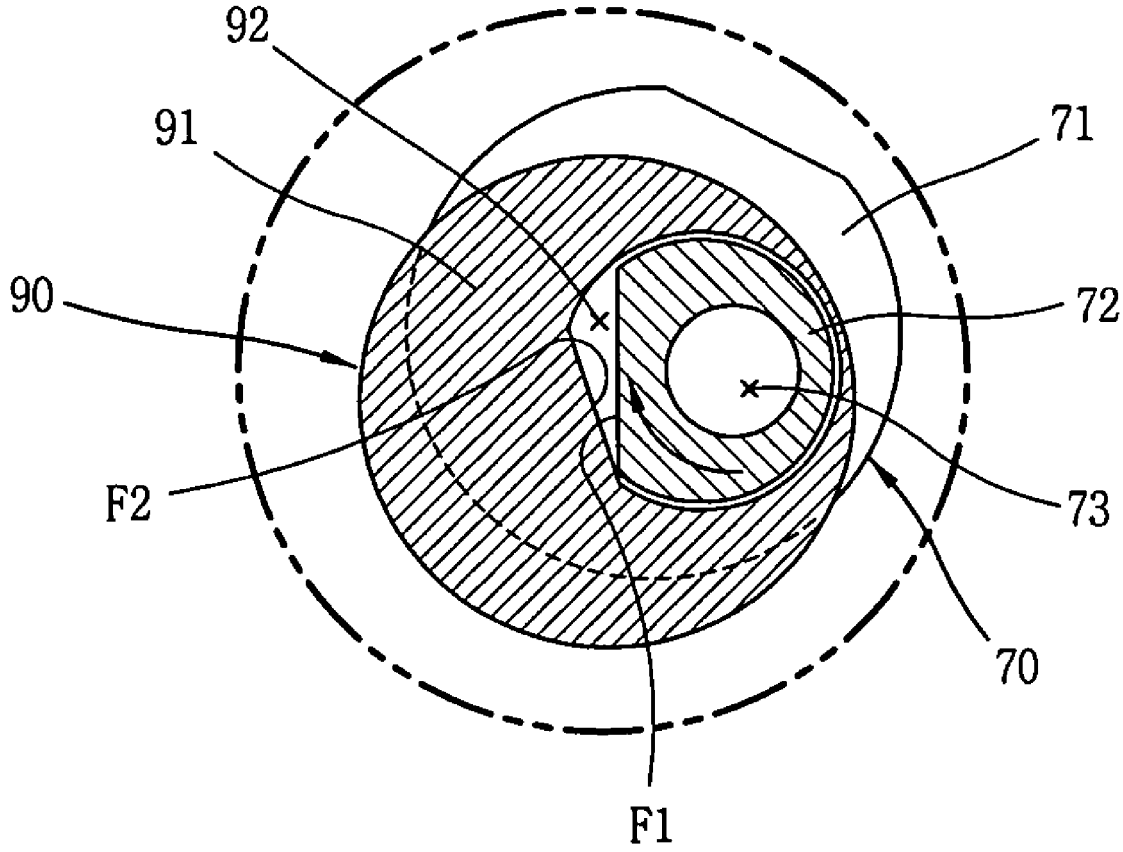
FIG. 3 CONVENTIONAL ART
FIG. 3 is a plan section view illustrating an operation of the coupling structure of the eccentric bush of the conventional scroll compressor.
Figure 4:
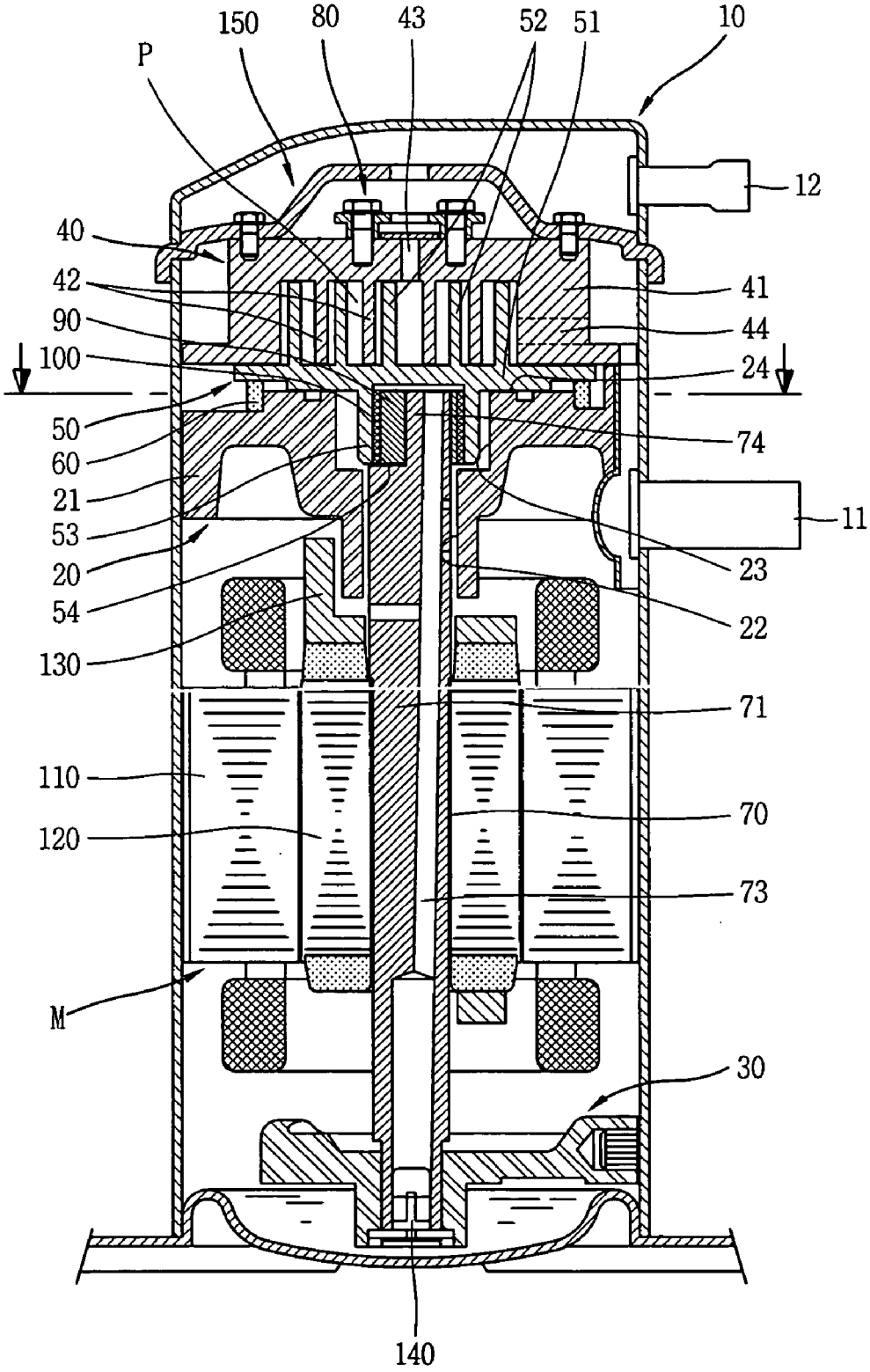
FIGS. 4 and 5 are a front section view and a plan section view illustrating a scroll compressor provided with one embodiment of a coupling structure of an eccentric bush of a scroll compressor of the present invention.
Figure 5:
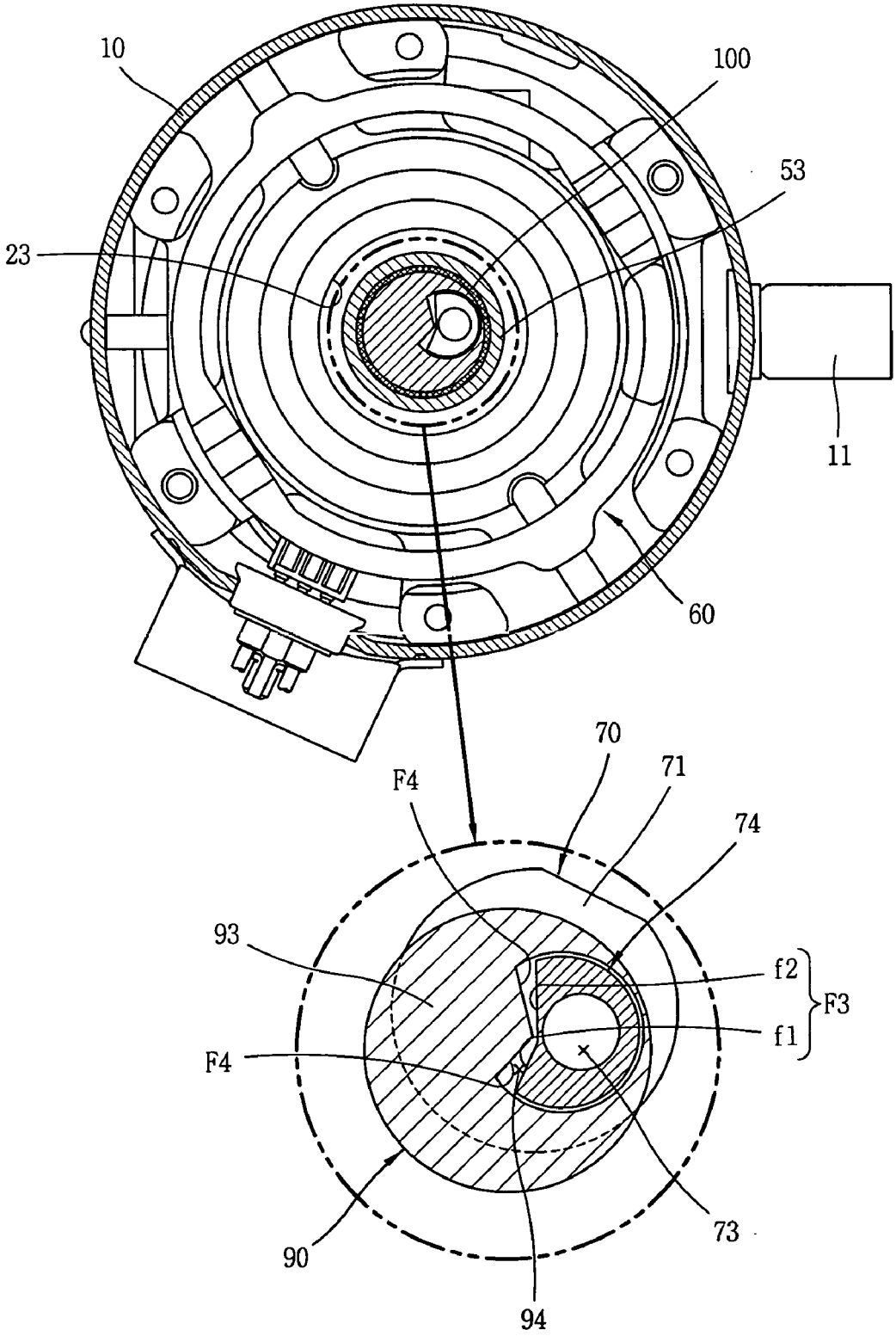

FIGS. 4 and 5 are a front section view and a plan section view illustrating a scroll compressor provided with one embodiment of the coupling structure of the eccentric bush of the scroll compressor of the present invention. Identical reference numerals are given to the same part as the conventional art.

As shown therein, the scroll compressor includes: a casing 10 provided with a suction pipe 11 and a discharge pipe 12; a main frame 20 and a sub-frame 30 fixedly coupled to the upper and lower portions inside of the casing 10, respectively, with a certain interval; a fixed scroll 40 fixedly coupled to the casing 10 so as to be positioned at an upper side of the main frame 20; an orbiting scroll 50 positioned between the fixed scroll 40 and the main frame 20 so as to be orbitably interlocked with the fixed scroll 40; an Oldham ring 60 positioned between the fixed scroll 40 and the main frame 20, for preventing a self-rotation of the orbiting scroll 50, a driving motor (M) fixedly coupled to the casing 10 so as to be positioned between the main frame 20 and the sub-frame 30, for generating a driving force; a rotary shaft 70 for transferring the driving force of the driving motor (M) to the orbiting scroll 50; and a valve assembly 80 mounted on an upper surface of the fixed scroll 40.

Such a construction is the same as that in the conventional art.

Meanwhile, the orbiting scroll 50 includes: a circular plate part 51 having certain thickness and area; a wrap 52 formed in an involute curve shape of certain thickness and height at one side of the circular plate part 51; a boss part 53 penetratingly formed at the center portion of the other side of the circular plate part 51 to a certain height; and a shaft insertion groove 54 formed inside the boss part 53 to a certain depth, into which part of the rotary shaft 70 is inserted.

The rotary shaft 70 includes: a shaft part 71 having a certain length; an eccentric part 74 extending from one side of the shaft part 71 to a certain length so as to be eccentric from the center of the shaft part 71; and an oil path 73 penetratingly formed at the shaft part 71 and the eccentric part 74.

As for the rotary shaft 70, the shaft part 71 is coupled with the driving motor (M). One side of the shaft part 71 of the rotary shaft 70 is penetratingly inserted into the main frame 20 and the eccentric part 74 is inserted into the shaft insertion groove 54 of the boss part of the orbiting scroll.

Then, an eccentric bush 90 of predetermined shape is inserted into the eccentric part 74 of the rotary shaft. As the eccentric part 74 of the rotary shaft and the eccentric bush 90 plane-contact each other during the rotation of the rotary shaft, rotary power of the rotary shaft is transferred to the orbiting scroll through the eccentric bush 90.

A fixed bush 100 slidingly contacting the eccentric bush 90 is fixedly coupled with an inner wall of the shaft insertion groove 54 of the orbiting scroll.

The eccentric part 74 of the rotary shaft is formed in such a manner that a cutting surface (F3) plane-contacting the eccentric bush 90 is formed at an outer circumferential surface of a cylindrical shape with certain length and outer diameter. The center of the eccentric part 74 is located at the position where it is eccentric from the center of the shaft part 41 with a certain distance.

The cutting surface (F3) of the eccentric part 74 is made up of two contact planes: a first contact plane (f1) and a second contact plane (f2).

The first contact plane (f1) and the second contact plane (f2) are continuously formed. The first contact plane (f1) and the second contact plane (f2) have an included angle less than 180 degrees.

The eccentric bush 90 includes a cylindrical body portion 93 having certain length and outer diameter and an insertion hole 94 provided with two plane contact portions (F4) of predetermined areas penetratingly formed at the cylindrical body portion 93. The radius of the insertion hole 94 corresponds to that of the eccentric part 74 of the rotary shaft. The plane contact portions (F4) are formed at one inner circumferential surface of the insertion hole.

The two plane contact portions (F4) of the eccentric bush 90, that is, the first plane contact portion (F4) and the second plane contact portion (F4) are continuously formed. The first plane contact portion (F4) and the second plane contact portion (F4) have an included angle greater than 180 degrees.

The center of the insertion hole 94 is located to be eccentric from that of the cylindrical body portion 93 with a certain distance.

The eccentric bush 90 is coupled with the rotary shaft 70 such that the eccentric part 74 is inserted into the insertion hole 94. The plane contact portions (F4) of the eccentric bush and the cutting surface (F3) of the eccentric part 74 are positioned to face each other, and a predetermined interval is formed between the plane contact portions (F4) of the eccentric bush and the cutting surface (F3) of the eccentric part 74. It is through the predetermined interval that the oil is supplied.

The eccentric bush 90 coupled to the eccentric part 74 of the rotary shaft is inserted into the insertion groove 54 formed at the boss part 53 of the orbiting scroll.

Hereinafter, an operational effect of the coupling structure of the eccentric bush of the scroll compressor of the present invention will be described as follows.

Firstly, as described above, the scroll compressor is operated in such a manner that rotary power generated from the driving motor (M) is transferred to the orbiting scroll 50 through the rotary shaft 70. As the rotary power of the rotary shaft 70 is transferred to the orbiting scroll 50, the orbiting scroll 50 coupled to the eccentric part 74 of the rotary shaft orbits on the basis of a central axis of the rotary shaft 70. Prevented from its self-rotation by means of the Oldham ring 60, the orbiting scroll 50 orbits.

As the orbiting scroll 50 orbits, the wrap 52 of the orbiting scroll is interlocked with the wrap 42 of the fixed scroll, orbits, and compresses the gas.

The oil filled in the lower part of the casing 10 flows via the oil path 73 of the rotary shaft by the rotation of the rotary shaft 70 and is supplied to components where a sliding motion is generated.

Figure 6:
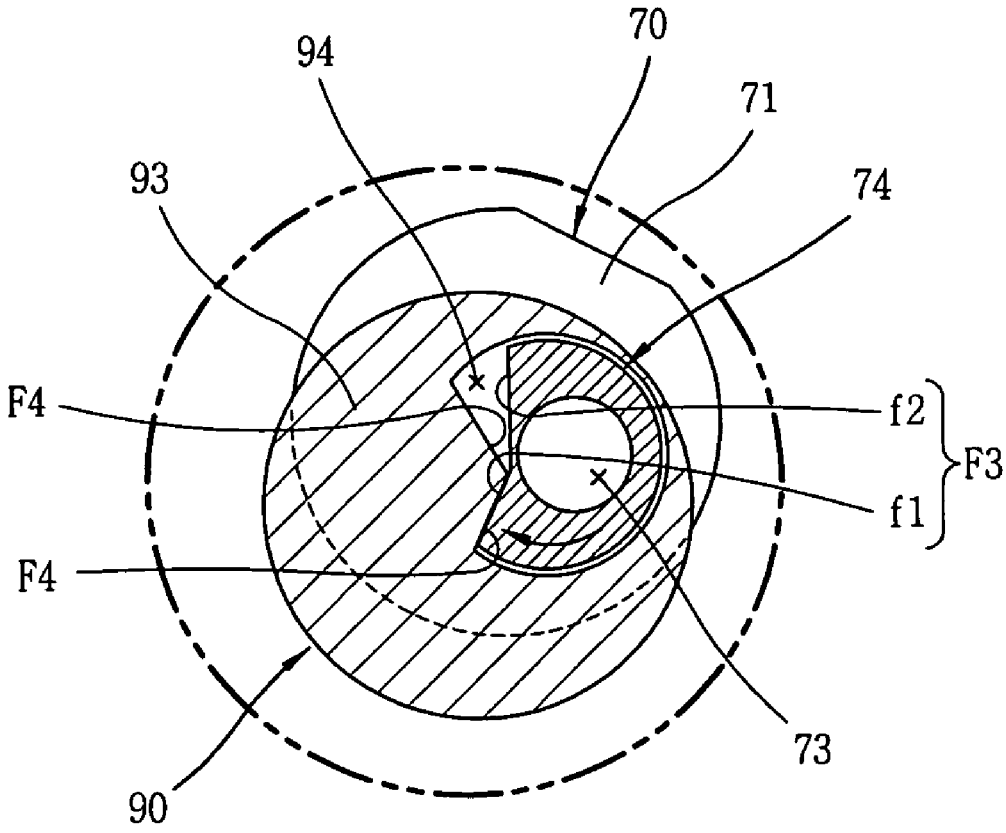
FIG. 6 is a cross-sectional view illustrating an operation of the coupling structure of the eccentric bush of the scroll compressor of the present invention.

In the processes, when the rotary power of the driving motor (M) is transferred to the rotary shaft 70 and thus the shaft body 71 of the rotary shaft is rotated, the eccentric part 74 of the rotary shaft moves in a circular motion. The circular motion of the eccentric part 74 is transferred to the orbiting scroll 50 through the eccentric bush 90, so that the orbiting scroll 50 orbits. When the eccentric part 74 of the rotary shaft transfers the rotary power to the orbiting scroll 50 through the eccentric bush 90, as shown in FIG. 6, one contact plane of the cutting surface (F3) comes in contact with the plane contact portion (F4) opposite to the contact plane of the cutting surface (F3), thereby transferring the rotary power. Since the eccentric part 74 of the rotary shaft and the eccentric bush 90 surface-contact each other such that the rotary power of the rotary shaft 70 is transferred to the orbiting scroll 50 through the eccentric bush 90, the power applied to the eccentric part 74 of the rotary shaft and the eccentric bush 90 is not concentrated to a portion but is dispersed.

Meanwhile, the oil having flowed via the oil path 73 formed inside the rotary shaft 70 flows through the interval between the cutting surface (F3) of the eccentric part 74 of the rotary shaft and the plane contact portions (F4) of the eccentric bush.

As so far described, the coupling structure of the eccentric bush of the scroll compressor in accordance with the present invention can increase reliability by preventing damage to the eccentric part 74 of the rotary shaft or the eccentric bush 90 by preventing concentrated stress from being applied to a predetermined portion of the eccentric part 74 and the eccentric bush 90 by dispersing the power applied between the eccentric part 74 and the eccentric bush 90 because the rotary power applied between the eccentric part 74 and the eccentric bush 90 is transferred by surface-contact in a process that the rotary power of the rotary shaft 70 transferred from the driving motor (M) is transferred to the orbiting scroll 50 through the eccentric bush 90.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A coupling structure of an eccentric bush of a scroll compressor, comprising:

an orbiting scroll;

a rotary shaft provided with an eccentric part and transferring rotary power of a driving motor to the orbiting scroll; and an eccentric bush coupled between the orbiting scroll and the eccentric part of the rotary shaft, wherein an insertion hole provided with two plane contact portions angled with respect to each other and having predetermined areas is formed at the eccentric bush, a cutting surface made up of two contact planes surface-contacting at least one of the plane contact portions of the eccentric bush is formed at the eccentric part of the rotary shaft, and the eccentric part is inserted into the insertion hole of the eccentric bush.

2. The structure of claim 1, wherein the two plane contact portions of the eccentric bush are continuously formed.

3. The structure of claim 1, wherein the two plane contact portions have an included angle greater than 180 degrees.

4. The structure of claim 1, wherein the two contact planes and are continuously formed.

5. The structure of claim 1, wherein the two contact planes have an included angle less than 180 degrees.

6. The structure of claim 1, wherein the radius of the insertion hole of the eccentric bush is identical with that of the eccentric part of the rotary shaft.

7. The structure of claim 1, wherein a predetermined interval is formed between the plane contact portions of the eccentric bush and the cutting surface of the eccentric part.

8. The structure of claim 1, wherein the center of the insertion hole of the eccentric bush is eccentric from the center of the eccentric bush with a certain distance.

* * * * *